United States Patent [19]

Aalto et al.

[11] Patent Number: 4,890,544

[45] Date of Patent: Jan. 2, 1990

[54] AIR DISTRIBUTION SYSTEM

[75] Inventors: Erkki Aalto; Teuvo Pellinen; Jouko Eloranta, all of Kausala, Finland

[73] Assignee: Halton Oy, Finland

[21] Appl. No.: 235,876

[22] PCT Filed: Dec. 28, 1987

[86] PCT No.: PCT/FI87/00173

§ 371 Date: Aug. 17, 1988

§ 102(e) Date: Aug. 17, 1988

[87] PCT Pub. No.: WO88/05147

PCT Pub. Date: Jul. 14, 1988

[30] Foreign Application Priority Data

Dec. 30, 1986 [FI] Finland ..... 865351

[51] Int. Cl.[4] ..... F24F 9/00

[52] U.S. Cl. ..... 98/36; 98/40.11; 98/115.1

[58] Field of Search ..... 98/36, 40.01, 40.05, 98/40.1, 40.11, 115.1, 115.3; 165/16

[56] References Cited

U.S. PATENT DOCUMENTS

| | | | |
|---|---|---|---|
| 3,776,121 | 12/1973 | Truhan | 98/36 X |
| 4,055,112 | 10/1977 | Larfeldt | 98/36 X |
| 4,164,173 | 8/1979 | Douglas | 98/36 |

FOREIGN PATENT DOCUMENTS

| | | | |
|---|---|---|---|
| 2917725 | 11/1980 | Fed. Rep. of Germany . | |
| 61093 | 1/1982 | Finland . | |
| 66484 | 6/1984 | Finland . | |
| 2272345 | 12/1975 | France . | |
| 247960 | 7/1987 | German Democratic Rep. | 98/40.01 |
| 2166220 | 7/1987 | Japan | 98/36 |
| 213277 | 2/1965 | Sweden . | |
| 312656 | 7/1969 | Sweden . | |
| 334991 | 5/1971 | Sweden . | |
| 351287 | 9/1972 | Sweden . | |
| 442909 | 2/1986 | Sweden . | |
| 448335 | 2/1987 | Sweden . | |
| 524114 | 7/1972 | Switzerland . | |
| 1257367 | 9/1986 | U.S.S.R. | 98/36 |

OTHER PUBLICATIONS

Halton Produktblad, pp. 4.1.1–4.1.2, issued May 1986 (Taby), "Luftspridare THA".

Fläkt Katalog, issued Jun. 1983, acc. nr. 434/83, "Luftridatak" (Taby), E46 pp. 1–4.

Halton Produktblad, pp. 8.1.1–8.1.3, issued Nov. 1986, "Lagimpulsdon LVA".

*Primary Examiner*—Harold Joyce

*Attorney, Agent, or Firm*—Steinberg & Raskin

[57] ABSTRACT

An air distribution system for distributing air downward from above with very low velocity. The air distribution system has an air distribution terminal (10) from which the air has been arranged to descend substantially merely by gravity effect, with very low velocity. Desired velocity of descent of the air descending from the air distribution terminal (10) has been accomplished by producing a temperature differential between the room air and the air that is conducted from the air distribution terminal (10).

12 Claims, 7 Drawing Sheets

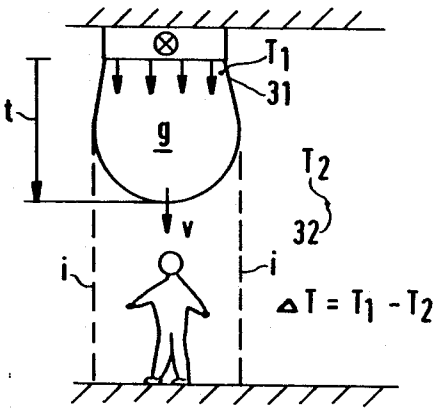
FIG. 11B
FIG. 11A
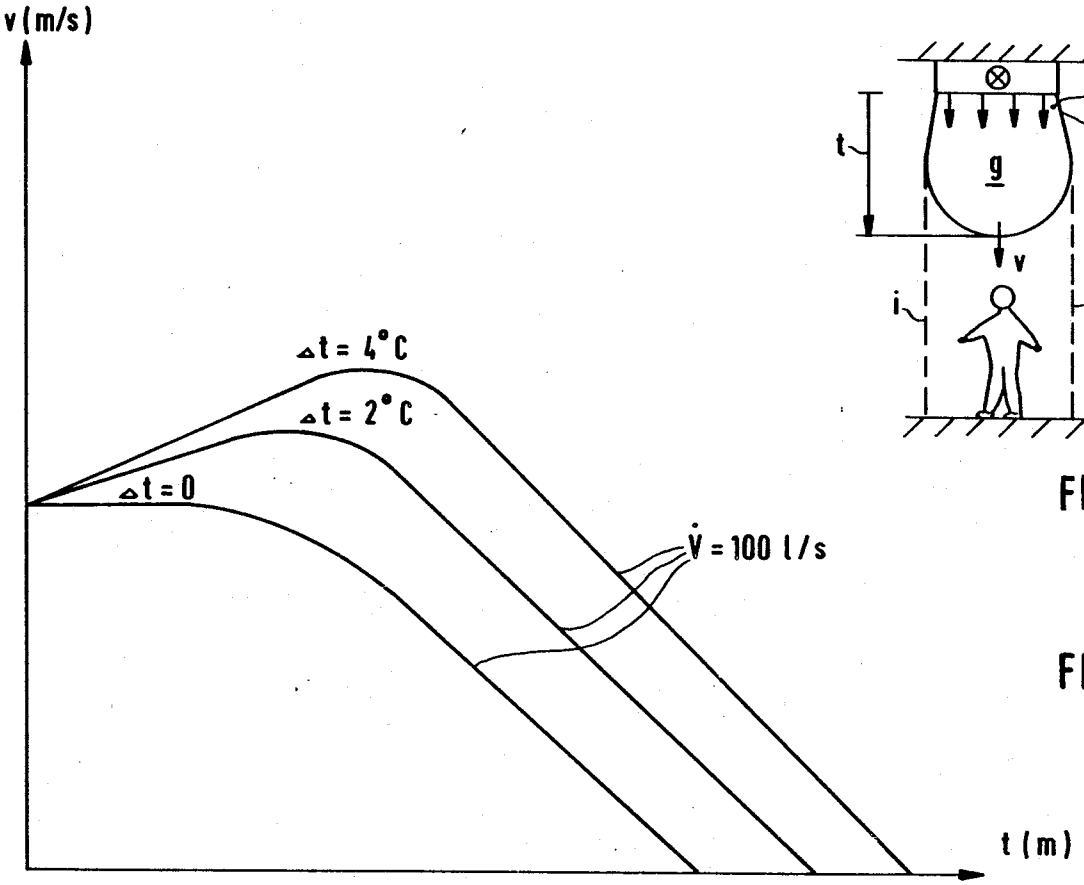

AIR DISTRIBUTION SYSTEM

BACKGROUND OF THE INVENTION

The invention concerns an air distribution system for distributing air downward from above at very low velocity, and said air distribution system comprising an air distribution terminal means.

Such air distribution systems are known in prior art in which the air is guided from a terminal means individually to different working places so that the air discharging from the terminal means encounters the person present in the staying area. It is however a fact that the air supply produces a sensation of draught and thus renders ventilation undesirable. It is also a fact that the worker himself has no access to the control of the air entering his staying area.

SUMMARY OF THE INVENTION

The object of the invention is an air distribution system of completely novel kind, in which the drawbacks of conventional interior air replacement ventilation have been successfully avoided and in which air distribution to individual working places has been successfully implemented, whereby the air distribution event is also controllable by action of the person working at the respective working place. The object of the invention is specifically an improvement of air distribution.

The system of the invention is mainly characterized in that the air distribution system comprises an air distribution terminal means from which the air has been arranged to descend substantially merely by gravity effect at very low velocity, and that the desired velocity of descent of the air descending from the terminal means has been achieved by producing a temperature differential between the room air and the air that is conducted from the air distribution terminal means.

BRIEF DESCRIPTION OF THE DRAWINGS

The invention is more closely described in the following, referring to certain advantageous embodiments of the invention, presented in the accompanying drawings. The invention however is not being meant to be exclusively confined to said embodiments.

FIGS. 11A and 11B illustrate the control principle applied in the system of the invention. The presentation is graphically illustrated in FIG. 11A and schematically illustrated in FIG. 11B.

DESCRIPTION OF THE PREFERRED EMBODIMENTS

Figure 1:
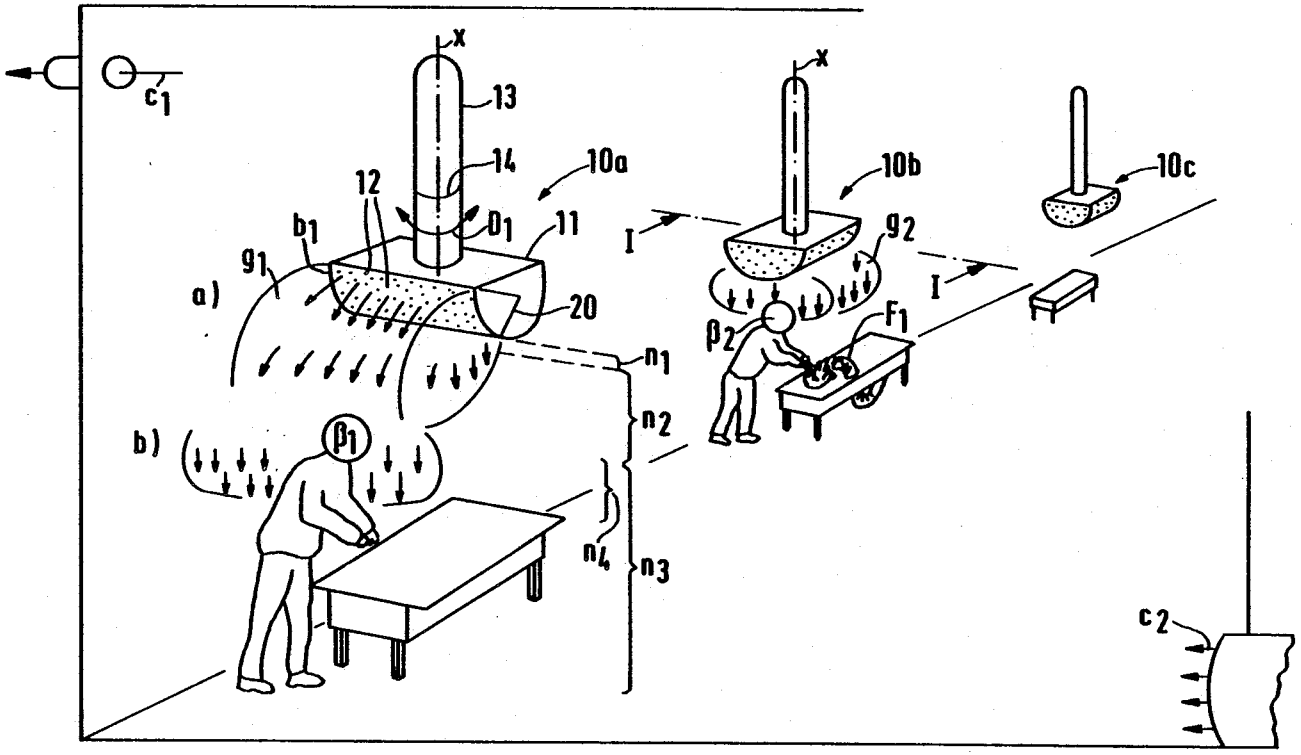
FIG. 1, the air distribution system of the invention is schematically presented by showing an air distribution means design conforming to the invention.

Referring now to FIG. 1, therein is depicted the procedure of the invention, in one advantageous embodiment of same and in schematical presentation. In the figure, the terminal member-individual, i.e., working place- or working point-individual, air distribution system of the invention has been presented.

The room space, indicated with A, comprises a plurality of working point-individual air distribution means 10. With each air distribution means 10 are associated: a supply duct 13, a frame shell 11 of the air distribution means, air discharge apertures 12, and a control means 20. In the embodiment of FIG. 1, three air distribution means 10*a*, 10*b*, 10*c* have been shown, accommodated in the room space A.

In the figure two persons $B_1$ and $B_2$ have been presented, each working at his/her own working point. The third air distribution means is shut off, the respective person being absent from the working point.

In the procedure of the invention, the air has been arranged to be transported into the breathing zone of the person, substantially without impulse and substantially utilizing gravity (utilizing thermal forces). As taught by the invention, the air has been arranged to enter the breathing zone of the person working as the specific working place object, most advantageously, with a velocity of 0.1–0.6 m/s. As taught by the invention, uncomfortable sensation of draught is avoided by means of said gravity-based air distribution.

In the figure the subdivision of the room space has been shown, arranged in conjunction with one of the air distribution terminal members, into a proximity zone $n_1$, an intermediate zone $n_2$ and a staying zone $n_3$, the latter being further divided into the breathing zone $n_4$, which is considered to be substantially confined to the upper part of the person's body and trunk.

As taught by the invention, the air is arranged to be distributed from the terminal member, most advantageously and in the preferred embodiment of the invention, through a perforated plate. The perforated plate comprises a plurality of air discharge apertures 12. In the embodiment of FIG. 1 the air has been arranged to go to the first working point from the air distribution means 10*a* so that the air is arranged with the aid of a control means 20 to be substantially deflected before the breathing zone so that one obtains the desired air throw pattern and an air deposition, in the breathing zone of the respective person, consistent with the extreme regions of said air throw pattern. It is essential, according to the invention, that with the means 20 the air is distributed already substantially in the vicinity of the terminal member in such a way that the desired air deposition profile is obtained.

In FIG. 1 has been illustrated, in connection with the first air distribution terminal means 10*a*, the control event wherein the air has been arranged to be distributed from one curved side face $b_1$ of the first air distribution means 10*a*, substantially to one side of the air distribution means. The desired air flow pattern will be obtained, and the air ($g_1$) will descend by gravity effect from the side of the air distribution terminal means 10*a*, with desired profile, to the breathing region of the person's staying zone.

The terminal means 10*a* which are parts of the working place-individual air distribution of FIG. 1 may be controlled not only with the control means 20 but also by an arrangement in which the terminal means 10*a*, 10*b*, 10*c* is rotatable about its central axis x (arrow $D_1$), in which case on the air supply duct 13 a pivot means 14 is provided to enable said rotation.

In the embodiment of FIG. 1, the air has been arranged to be distributed from one curved side $b_1$ of the means 10*a* through discharge apertures 12 there provided, and directed by the control member 20. The control member 20 has been depicted in FIG. 1 in the cut-open projection of its working place-individual control means 10*a*. The control means 20 is advantageously a continuous plate, or in another embodiment it is a stop part which comprises a deflection surface and a given number of holes for deflecting the air both to the side and for distributing the air also partly through the control member 20 and downward. In the embodiment of FIG. 1, the control means 20 in phase (a) thus distributes the air through the air discharge apertures 12 to the side. After this distribution to the side, the air falls in phase (b) by effect of gravity forces (thermal forces) into the staying zone $n_3$. In the figure this event is schematically depicted, and the air column $g_1$ has been arranged to fall by gravity effect and to meet the region of the person's head most advantageously with a velocity of 0.1–0.6 m/s. At this low encountering velocity of the air, the person will not experience any objectionable draught.

In FIG. 1 is also shown a second air distribution terminal member 10*b*, over the working point of the person $B_2$. The person $B_2$ has pointed, and adjusted, the supply of air to his own staying zone to suit his wishes. Therefore the air distribution event is completely different from that in the case of the person $B_1$, being dependent both on the object on which $B_1$ is working and also on his/her personal requirements.

The air velocity is, after a proximity zone $n_1$ of about 10 cm, from 0.1 m/s to 0.3 m/s. Therefore the air no longer has any significant impulse in the intermediate zone $n_2$. The height of the intermediate zone is 0.2.2 m at greatest advantage.

In the presentation of FIG. 1, the air distribution terminal means 10*b* has been set with the aid of the control means 20 of the control member so that the air column $g_2$ has been arranged to fall down to the spot desired by the person $B_2$ working at the respective working place, and downward in the figure. If for instance welding is being done at this working point, it is advantageous to dispose the air column $g_2$ to fall in such a way that it has sufficient mass to force, for instance, the flue gases from the welding process through an exhaust duct $F_1$, provided e.g. at floor level or in the work table, away from the working point. This air exhaustion operates in that the air column $g_2$ introduced from the terminal members by its own mass expels the flue gases from the working point.

As taught by the invention, the velocity of the air directed to the breathing zone of the staying zone is adjusted to be as desired, and favourably to be as small as is desired, by controlling the differential temperature $\Delta T$ between the air discharging from the terminal member 10 and the room air to be proper in magnitude. $\Delta T$ is, in FIG. 6, the differential between the temperature $T_1$ of the air discharging from the terminal member 10 and the temperature $T_2$ of the ambient room air ($\Delta T = T_1 - T_2$). Control of entering air is similarly effected at all other working place-individual air distribution system air distribution means in this particular room. If $\Delta T < 0$, the air tends by effect of thermal forces to move downward towards the breathing zone $n_4$, and if $\Delta T > 0$, the effect of thermal forces goes the opposite way.

As depicted in FIG. 1, the room space A may in addition comprise a displacement ventilation, in which case air is arranged to enter the lower part of the room space, as indicated by arrow $C_2$, and air is removed from the room from its upper part, as indicated by arrow $C_1$.

Figure 2A:
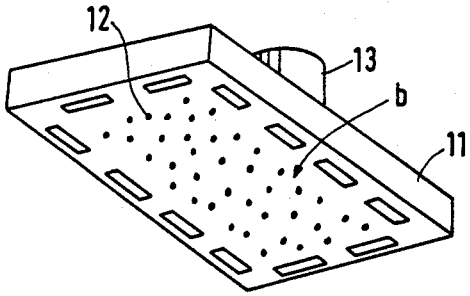
FIG. 2A illustrates another structural design of the air distribution means of the invention, in axonometric perspective.

In FIG. 2 is depicted another embodiment of the means applying the system or procedure of the invention. In this embodiment of the terminal member of the invention, the air has now been arranged to be distributed from a planar discharge surface b. The discharge surface b comprises a plurality of air entry apertures 12. The air distribution terminal means of the invention further comprises a control means, not depicted, within the housing structure. It is possible with said control means to direct the air to discharge from any desired area of the discharge surface b.

Figure 2B:
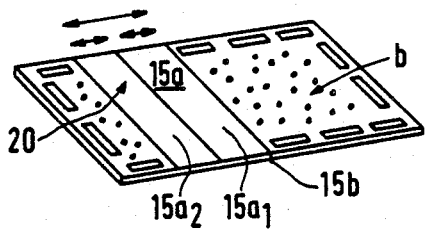
FIG. 2B illustrates an advantageous embodiment of the air discharge surface.

As depicted in FIG. 2B, the control means 20 consists of a cover plate 15 conforming to the discharge surface b. The cover plate 15*b* can be moved on the surface b so that the desired discharge area is obtained, the non-desired discharge area being covered. The cover plate may be moved, in FIG. 2B, with the aid of a control knob 15*b*, and the configuration and location of the cover plate can be moved within the area b. It is in this connection advantageous to compose the cover plate 15 for instance of a lamellated structure which can be expanded and reduced as to its coverage. In this embodiment of the invention it is equally possible to move the entire lamellated plate 15 from one location to another above the discharge surface b and in its immediate contiguity. The cover plate 15 may be pivoted to move relative to the housing structure of the terminal member 10 in socket grooves or equivalent provided on the housing structure.

Figure 3:
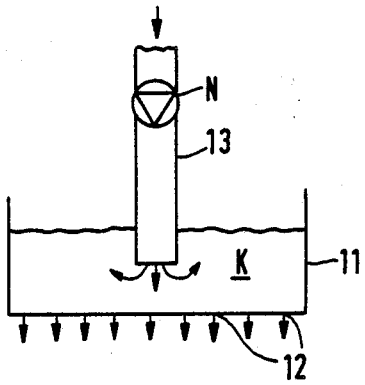
FIG. 3 is a schematic presentation of a principle embodiment of the air distribution system of the invention.

In FIG. 3 is schematically depicted, in principle, another implementation of the air distribution system of the invention. Air is supplied through the discharge pipe 13, into a collecting space K. It is essential that the discharge of air from the collecting space K is not influenced with the blower N. The air discharges from the space K through discharge apertures 12 in the housing 11, substantially by gravity effect (by effect of thermal forces due to differential temperatures).

Figure 4:
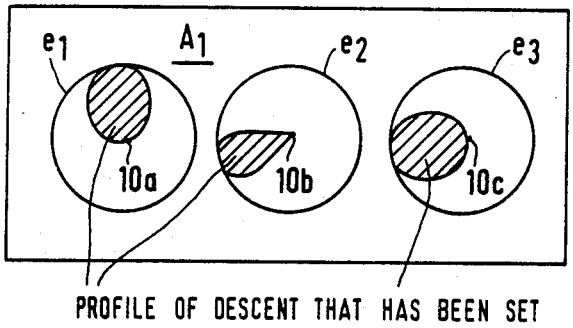
FIG. 4 illustrates the floor plan of a room, and the stations of the working place-individual air distribution means have been shown in this figure. As taught by the invention, each working place-individual low-velocity ventilation means can be regulated. The air descent patterns associated with each air distribution terminal means have been indicated in the figure.

In FIG. 4 is depicted the embodiment of the air distribution system of the invention installed in a given room space. In the figure is shown the floor plan of this room, and the presentation is schematical. The floor area of the room has been denoted with $A_1$. The room contains working point-individual air distribution means 10*a*, 10*b*, 10*c*. It is advantageous to provide a specific air distribution means for each working point.

In the figure has been indicated, with symbols $e_1$, $e_2$, $e_3$, the umbrage region in the air distribution pattern of each air distribution means. In the case of each air distribution means it is possible within the individual umbrage regions, within the indicated circles e, to implement the desired air distribution process, by making adjustments with the aid of the control means incorporated in each air distribution means. As provided by the invention, this control is effected individually at each working place, the person who works there being enabled from the point where he/she works to control the location of the descending air mass. The figure reveals that the entire working area in the room can be efficiently covered with the system of the invention.

In another embodiment of the invention (not depicted), one air distribution means serves two or three working points which are manned only part of the time. It is thus possible with one air distribution means to convey the descending air column to each working area, and to the working area desired in the particular case. It is thus possible, in this embodiment, to utilize one working place-individual air distribution means extensively.

Figure 5:
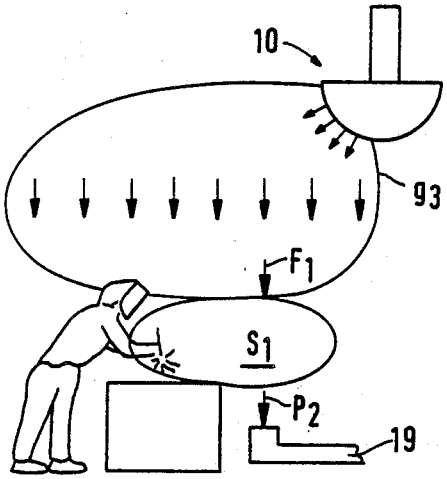
FIG. 5 schematically illustrates an embodiment of the ventilation according to the invention wherein the air distribution means has been disposed to produce a descending air mass in conjunction with a place assigned for welding work.

In FIG. 5 a ventilation installation according to the invention is depicted, at a welding place. As taught by the invention, a descending air mass of such magnitude is produced that it will by its own weight push the welding gases produced at this working place, to the exhaust on floor level and further to be drawn out from the room; or this air exhaustion may alternatively take place so that the descending air mass merely by its own weight pushes the gases, and other impurities, away from the working point. In the figure, the descending air mass, which comes from the working point-individual air distribution terminal means, is indicated with reference numeral $g_3$. It gives rise to a force $F_1$, indicated with an arrow in the figure, to act on the welding gas, which is indicated with reference numeral $S_1$. The incoming air column $g_3$, with greater mass, pushes the impurity gas $S_1$ downward with the force $F_1$ so that the impurity gas cloud is pressed by effect of the force $F_1$, through the exhaust duct 19 in the lower part of the room space, as indicated by arrow $F_2$, out and away from the working point. As taught by the invention, the air quantity discharging from the entering air means is adjusted individually at each working place so that with the descending air mass the effect is achieved that it presses the impurity gas cloud out from the room space, as indicated by arrow $P_2$. This blowing out of exhaust gases can be promoted with the aid of suction created in the duct 19 by means of a blower, but in the most advantageous embodiment of the invention adjustments are applied to create an air column $g_3$ of such weight that it will suffice to press the impurities away from the working point.

Figure 6:
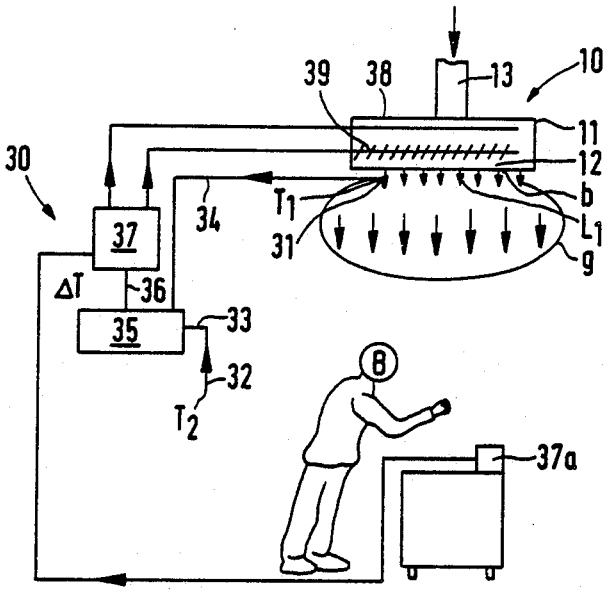
FIG. 6 schematically illustrates a control principle for the air distribution system of the invention.

In FIG. 6 the control means of the air distribution system of the invention and the control design is depicted, party schematically. As taught by the invention, the transport of air to the staying zone of the person B is essentially either exclusively by effect of gravity (of thermal forces). As taught by the invention, fine tuning of air velocity is effected, in the procedure, by controlling the temperature of the air discharging from the terminal means 10 in dependence of the measured temperature in the room space A. This implies that, as taught by the invention, a temperature pick-up is located both in the ambient room space outside the path of the descending air column and in the incoming air, and most advantageously adjacent to the discharge surface b of the terminal member. In the procedure of the invention, the temperature of the air discharging (arrow $L_1$) from each air distribution terminal means 10 is controlled within each working area in the room space A. The control means 30 comprises, in an advantageous embodiment of the invention, a measuring pick-up 31 located in the vicinity of the perforated discharge surface b, and which measures the temperature $T_1$ of the air immediately as it discharges from the working place-individual air distribution terminal means 10, and the control means 30 comprises a second pick-up 32, which is most advantageously arranged to be located in the ambient room air, outside the descending air flow. The temperature pick-up 32 measures the temperature $T_2$. The measurement information is conveyed from the pick-up 32 by a signal path 33 to means 35 for computing the differential temperature. The measured temperature data produced by the pick-up 31 comes from the pick-up 31 by the signal route 34. Measurement information concerning the differential temperature $\Delta T$ is transferred from the means 35 by the signal route 36 to control means 37, in which the adjustable, working point-individual low air velocity has been preset. The control 37*a* is used to set the desired low air velocity in the person's staying zone, and the control means 37 takes by the signal route 36 the differential quantity $\Delta T$ that has been measured and, on the basis thereof, controls either heating means 38 or cooling means 39 in such manner that the desired differential temperature $\Delta T$ is obtained between the breathing zone and the air discharging from the means 10. It is to advantage if both the heating means 38 and the cooling means 39 are located inside the housing structure 11 of the air distribution terminal means 10, and advantageously immediately before the discharge surface b. It is also to maximum advantage if the discharge surface b consists of a perforated plate and/or filtering means. The working person is enabled, by operating the control knob 37*a*, to select, at each working point, the discharging air to have the desired low air velocity. It is possible with the control means of the invention to implement adjustment of the air velocity encountered by the person with an accuracy which is even better than 0.1 m/s.

Figure 7A:
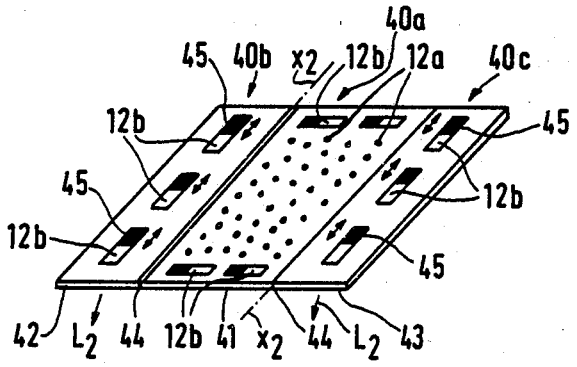
FIG. 7A illustrates another control system for the air distribution system of the invention.

In FIG. 7A is depicted an advantageous air control principle, and the respective means. The discharge surface 40*a* comprises a plurality of air discharge apertures 12*a*. A first air discharge surface area 40*a*, this being preferentially the central area, comprises the air discharge apertures 12*a*. On the margins have been provided second air discharge areas producing a curtain air flow, so-called curtain areas 40b and/or 40c. In the curtain area 40a and 40c are located curtain air discharge apertures 12b. The curtain jet plates 42 and 43 are hinged to the central plate 41 with hinging means 44. It is thus possible, as taught by the invention, to change the positioning of the curtain plates 42,43 relative to the central discharge surface 40a and to the central plate section 41. As taught by the invention, the direction of the discharge planes of the discharge apertures 12b can be changed relative to the air discharge planes of the discharge apertures 12a.

The purpose with the curtain plates 42 and 43 is to prevent air coming from the outside from being mixed with the air discharging from the terminal member 10. On the other hand, said curtain plates may be used to control this mixing process, this being done by orienting the curtain plates as desired relative to the central discharge surface 40a and to the central plate 41. Such an embodiment is also conceivable in which the discharging area of the discharge aperture at the discharge apertures 12b in the curtain plates 42 and 43 is controlled. Each discharge aperture 12b may advantageously comprise a cover plate 45. This cover plate may either totally or partially close the discharge apertures 12b of the curtain flows.

Such a non-depicted embodiment is also conceivable in which by controlling the discharge surface area of the discharge apertures 12b for the curtain flows $L_2$ the discharge surface area of the discharge apertures 12b in the principal air discharge surface 40a can be influenced, and advantageously such influence may be exerted so that when the surface area of the discharge apertures 12b in the curtain plates 42,43 is increased, the discharge surface area of the apertures 12a in the central discharge area 40b is correspondingly reduced, and vice versa.

Figure 7B:
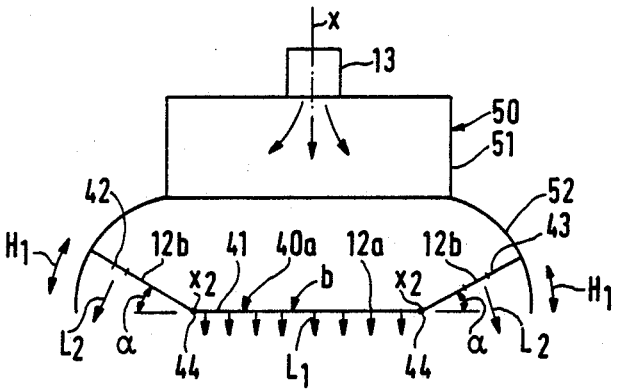
FIG. 7B illustrates, in a cross section diagram, the plate of FIG. 7A, installed in the housing structure of the air distribution terminal means.

In FIG. 7B an advantageous embodiment of the invention is depicted the plate of FIG. 7A has been incorporated in the housing structure 50. The figure is a sectional drawing and partly a principle diagram. The hinged air distribution terminal plate of FIG. 7 has been incorporated in the housing structure 50, which comprises a straight body portion 51 and a curved end portion 52 connecting therewith, the shape of the latter being chosen so that the curtain plates 42,43 as in FIG. 7A can be moved along the inner surfaces of the curved plate 52. To greatest advantage, the curvature of the plate 52 then equals the distance from the outer end face of the curtain plate 42,43 to the central axis $x_2$ of the hinge means 44. By moving the curtain plates 42 and/or 43 as indicated by arrow $H_1$, the position of the curtain plates relative to the main discharge surface 40a is controlled, and the curtain flows are hereby directed either straight downward, paralleling the central axis x, or at an angle against the central axis x. In the figure the angle of the curtain plates with reference to the main discharge surface 40a has been denoted with $\alpha$. The angle $\alpha$ is advantageously between 0 and 80° in the embodiment of FIG. 7B.

Figure 8:
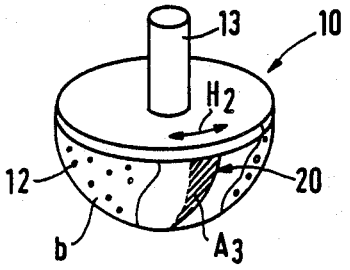
FIG. 8 illustrates another air distribution terminal means according to the invention. The means is shown, in this projection, partly cut open to reveal the control elements inside the means.

In FIG. 8 is depicted another terminal means design, in axonometric perspective and partly sectioned. In the figure, the terminal means 10 comprises a spherical discharge surface b, in which a number of hole apertures 12 has been provided, close together and advantageously with equal spacing. Fitting the spherical surface, a control means 20 has been installed in the interior space of the terminal means, this control means being advantageously a shutter blind in this embodiment. The control means 20, being a blind, has been disposed to move in contiguity with the inside surface of the spherical surface b and to cover always part of the discharge apertures 12. The blind 20 has been disposed to be movable along the spherical discharge surface b into such position as may be desired. The effective covering surface $A_3$ of the blind can be changed by spreading out and contracting the blind. This control process has been indicated with arrow $H_2$ in FIG. 8. In addition to the option of changing the effective covering surface $A_2$ of the blind, the blind may also be moved into another position so that it can be made to cover any desired sector of the perforated area of the spherical surface b. In the embodiment of the invention concerned in FIG. 8, the blind can be moved with the aid of guides or equivalent disposed in the vicinity of the perforated surface, and the blind has been disposed to be controllable by providing a guide groove through the perforated surface, for carrying the blind control knob through passes.

Figure 9:
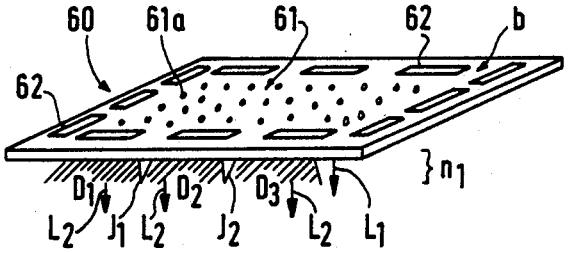
FIG. 9 illustrates, in axonometric perspective, another advantageous embodiment of the perforated plate associated with the air distribution terminal member. The significance in the air distribution event of the curtain flow apertures is schematically indicated in this embodiment.

In FIG. 9 is depicted an embodiment of the invention in which the air discharge plate 60 comprises a central main discharge area 61 comprising several discharge apertures 61a having advantageously circular cross section or rectangular cross section. In this embodiment the discharge surface b is planar, and the discharge plate 60 has been formed of curtain flow apertures 62 disposed on each margin of the plate, these apertures being most advantageously rectangular in shape.

FIG. 9 also illustrates the operation of the curtain flow. The task of the curtain flows in the procedure and means of the invention is to prevent any mixing of room air with the incoming air which discharges from the means, in a proximal zone of the plate 60. As taught by the invention, the curtain flow apertures 62 have been disposed on the margins of the plate in such manner that the flow cones $D_1$, $D_2$ discharging from them will minimize the free intervening area $J_1$ remaining between said cones. Some air from the ambient air may become admixed through said intervening area $J_1$, but such mixing has been minimized by means of the flow dispositions of the invention. It is essential in the curtain flow operation of the invention that the curtain flow apertures 62 have been disposed to encircle the entire main discharge surface 61, and that the curtain flows specifically prevent admixture of room air to the incoming air discharging from the apertures 61a, in the immediate contiguity of the discharge plate 60.

Figure 10A:
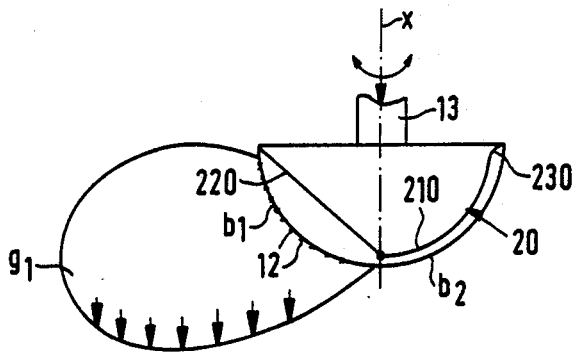
FIG. 10A illustrates, in cross section, the air distribution terminal member of FIG. 1, the section being carried along the line I—I and one adjustment being shown.

In FIG. 10A is depicted an embodiment of the air distribution discharge means consistent with FIG. 1. Here is presented a cross section through the air distribution terminal means 10, carried along the line I—I in FIG. 1. In FIG. 10A is shown an embodiment of the invention in which the control means 20 has been disposed, with the aid of suspensions 220 and 230, in a position which has been deflected from the central axis x of the means. The covering surface 210 directs the air coming through the duct 13, towards the perforated surface b and to discharge through the area $b_1$. In this way a descending air column $g_1$ is created on one side of the central axis x, and the other side of the means 10 passes hardly any air.

Figure 10B:
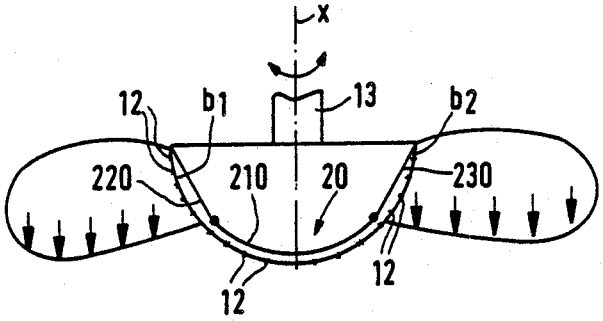
FIG. 10B illustrates another position of the control member associated with the air distribution control means, and the corresponding air distribution event.

In FIG. 10B another embodiment is depicted, featuring another kind of adjustment of the control means 20. The control means 20 has now been suspended centrally with reference to the central axis x. Air columns are now, in this embodiment, created on both curved surfaces $b_1$ and $b_2$, on either side of the central axis. In the embodiment of the air distribution terminal means of the invention as shown in FIGS. 1A and 10B the means can also be rotated about the central axis x. The covering surface 210 in the control means 20 may to greatest advantage be a curved surface and be consistent with the curvature of the surfaces $b_1$ and $b_2$. The covering surface 210 may also comprise holes provided at a given spacing, or with adjustable spacing, and said holes may also be adjustable as to their discharge surface area.

FIGS. 11A and 11B illustrates the control procedure of the invention in principle. The control means 10 shown near the top margin of the figure has been arranged to produce a descending air column g. At least one first pick-up 31 is employed to measure the temperature $T_1$ of the air coming from the air distribution terminal means 10. At least one second pick-up 32 is employed to measure the temperature of the room air, and this latter temperature is measured at a point outside the range i through which the descending air column g passes. The projection of the descent of the air column g has been indicated with i. It is seen from the diagram that a certain buoyancy acts on the air column g, depending on the temperature of the air column and of the temperature $T_2$ in the room space surrounding it. The low velocity of the descending air column can be controlled, depending on said differential temperature. The graph in the figure has been plotted with the distance from the air distribution terminal means 10 for abscissa, said distance being denoted with t. The distance t may be stated in meters. The ordinates correspond to the low velocity control of the descending low velocity air column, implemented by means of differential temperature. With the means disposition of the invention, highly accurate control of the velocity of the descending air column is achieved, and the working person may himself/herself at each working place individually adjust the low velocity of the descending air column in accordance with the differential temperature.

We claim:

1. An air distribution system for distributing air downwardly from above with very low velocity, said air distribution system comprising (i) air distribution terminal means (10) arranged to direct the air therefrom to descend substantially merely by gravity effect with very low velocity, and (ii) means for producing a temperature differential between ambient air and the air that is conducted from said air distribution terminal means, whereby the desired velocity of descent of the air descending from said air distribution terminal means (10) is attained.

2. Air distribution system according to claim 1, wherein the system comprises control means for controlling the velocity of descent of the fresh air coming from the air distribution terminal means (10), so that by said control means, the differential temperature (ΔT) between the ambient air and the air discharging from said air distribution terminal means is influenced.

3. Air distribution system according to claim 1, wherein the system comprises at least two temperature-measuring pick-ups (31, 32) of which one pick-up (31) is disposed to be located substantially in incoming flow of the air discharging from said distribution terminal means and of which the other pick-up (32) is disposed to be located substantially in the ambient air surrounding said incoming air flow and substantially outside an air column descending from the air distribution terminal means (10), the pick-ups (31, 32) being employed to measure the temperature differential (ΔT) between the temperature of the fresh incoming air discharging from said air distribution terminal means (10) and the temperature of the surrounding air, and the velocity of the air descending from said air distribution terminal means (10) being controlled with the aid of said measured temperature differential (ΔT).

4. Air distribution system according to claim 1, wherein the air distribution system comprises control means (20) by the aid of which the descent profile of the air descending from said air distribution terminal means (10) is controlled.

5. Air distribution system according to claim 4, wherein said air distribution terminal means (10) comprises an air discharge surface (b) having numerous air discharge apertures (12), and curtain flow areas (**12*b***), the air discharging through these curtain flow areas preventing mixing of ambient air with the air coming from said air discharge surface (b).

6. Air distribution system according to claim 5, wherein said curtain flow areas (**12*b***) are mounted upon said terminal means to be adjustable in position relative to said discharge surface.

7. Air distribution system according to claim 4, wherein said curtain flow areas have flow cross-section areas which are adjustable.

8. Air distribution system according to claim 2, wherein said control means (20) for controlling the air descent profile comprises a cover plate of which a cover surface (210) has been disposed to cover a perforated surface (b) of said air distribution terminal means at least in part, whereby with the aid of said cover surface (210) of said control means (20), the site of a falling air column in a room can be controlled.

9. Air distribution system according to claim 2, wherein the air distribution system comprises in one room space or equivalent, at least two working place-individual air distribution terminal means (10), and the air distribution system comprises a separate control means (20) for each working place-individual air distribution terminal means (10), whereby a person working at a working place can, with said control means (20), adjust a site at a working point where a descending air column comes down, in such manner as desired.

10. Air distribution system according to claim 9, wherein the air distribution system comprises means by the aid of which any desired velocity of descent can be set for each working point.

11. The system of claim 1, wherein said producing means (ii) are coupled to said terminal means (i).

12. The system of claim 11, wherein said producing means (ii) additionally comprise heating or cooling means disposed in said terminal means (i).

* * * * *